US005864324A

United States Patent [19]

Acker et al.

[11] Patent Number: 5,864,324

[45] Date of Patent: Jan. 26, 1999

[54] TELESCOPING DEPLOYABLE ANTENNA REFLECTOR AND METHOD OF DEPLOYMENT

[75] Inventors: Roy M. Acker, Los Angeles, Calif.; Stephen A. Doncov, Trenton, Mich.; Michael J. Josephs, Hawthorne, Calif.

[73] Assignee: TRW Inc., Redondo Beach, Calif.

[21] Appl. No.: 647,524

[22] Filed: May 15, 1996

[51] Int. Cl.[6] ..... H01Q 15/20

[52] U.S. Cl. ..... 343/915; 343/912

[58] Field of Search ..... 343/912, 914, 343/915, 840, DIG. 2, 880, 881, 882, 883; H01Q 15/20

[56] References Cited

U.S. PATENT DOCUMENTS

| | | |
|---|---|---|
| 3,217,328 | 11/1965 | Miller . |
| 3,290,688 | 12/1966 | Kraus . |
| 3,397,399 | 8/1968 | R.R. Carman et al. . |
| 3,496,687 | 2/1970 | H.S. Greenberg et al. . |
| 3,509,576 | 4/1970 | McLain . |
| 3,530,469 | 9/1970 | W.J. Dailey et al. . |
| 3,576,566 | 4/1971 | Cover, Jr. . |
| 3,618,111 | 11/1971 | Vaughan et al. . |
| 3,631,505 | 12/1971 | Carman et al. . |
| 3,635,547 | 1/1972 | Rushing et al. . |
| 3,707,720 | 12/1972 | Staehlin et al. . |
| 3,717,879 | 2/1973 | Ganssle . |
| 3,780,375 | 12/1973 | Cummings et al. . |
| 3,855,598 | 12/1974 | Keller . |
| 3,987,457 | 10/1976 | Moore . |
| 4,001,836 | 1/1977 | Archer et al. . |
| 4,074,731 | 2/1978 | Archer . |
| 4,151,534 | 4/1979 | Bond . |
| 4,176,360 | 11/1979 | Leavy et al. . |
| 4,191,604 | 3/1980 | MacTurk . |
| 4,242,686 | 12/1980 | MacTurk . |
| 4,352,113 | 9/1982 | Labruyere . |
| 4,398,724 | 8/1983 | Wilson et al. . |
| 4,475,111 | 10/1984 | Gittinger et al. . |
| 4,475,323 | 10/1984 | Schwartzberg et al. . |
| 4,498,087 | 2/1985 | Imbiel et al. . |
| 4,527,166 | 7/1985 | Luly ..... 343/915 |
| 4,549,187 | 10/1985 | Levy . |
| 4,587,526 | 5/1986 | Ahl, Jr. . |
| 4,608,571 | 8/1986 | Luly . |
| 4,642,652 | 2/1987 | Herbig et al. . |
| 4,658,265 | 4/1987 | Heinze et al. . |
| 4,683,475 | 7/1987 | Luly . |
| 4,811,033 | 3/1989 | Ahl et al. . |
| 4,975,713 | 12/1990 | Sheriff . |
| 5,104,211 | 4/1992 | Schumacher et al. . |
| 5,334,990 | 8/1994 | Robinson . |

FOREIGN PATENT DOCUMENTS

| | | |
|---|---|---|
| 0290729 | 11/1988 | European Pat. Off. . |
| 63-088903 | 4/1988 | Japan . |
| 1305607 | 12/1989 | Japan . |
| 02237202 | 9/1990 | Japan . |
| 04288705 | 10/1992 | Japan . |

OTHER PUBLICATIONS

Larry R. D'Addario, "Microwave Technology Innovations In Orbiting VLBI," IEEE MTT–S Digest, Albuquerque, New Mexico, Jun. 1, 1992, pp. 1375–1378.

Tadashi Takano, et al., "A Tension–Truss Deployable Antenenna For Space–Use And Its Obtainable Characteristics," IEEE, Seattle, Washington, Jun. 19, 1994, pp. 878–880.

*Primary Examiner*—Donald T. Hajec
*Assistant Examiner*—Tho Phan
*Attorney, Agent, or Firm*—Michael S. Yatsko

[57] ABSTRACT

In accordance with the teachings of the present invention, a telescoping deployable mesh antenna reflector for space communication applications and a method of deployment is provided. The antenna reflector includes a plurality of telescoping radially extending ribs between which a plurality of interconnected guylines are secured to form a wire truss structure. The telescoping radially extending ribs include pivotally coupled inner and outer ribs that are collapsed and folded to stow the antenna. A highly reflective wire woven mesh is connected to the front surface of the wire truss structure with flexible radially extending strip members allowing for folding and telescoping of the antenna reflector.

18 Claims, 8 Drawing Sheets

TELESCOPING DEPLOYABLE ANTENNA REFLECTOR AND METHOD OF DEPLOYMENT

BACKGROUND OF THE INVENTION

1. Technical Field

This invention relates generally to compact antenna system structures and, more particularly, to a compact telescoping deployable antenna reflector structure.

2. Discussion of the Related Art

Antenna systems generally employ a reflector which serves as a ground plane to direct energy into a desired pattern. Antenna reflectors for space-related applications such as communication satellites are generally required to be relatively compact, lightweight, and capable of withstanding the exposure of a severe orbital environment. In addition to these design constraints, the reflector must meet stringent distortion requirements in order to attain desired performance requirements which are related to the aperture of the reflector.

Over the last several years, it has been a goal of the space industry to reduce the costs of both commercial and military satellite applications. One of the methods used to achieve this goal has been a shift from the use of large lift vehicles such as the Titan class vehicle or the Space Shuttle to medium launch vehicles such as the Atlas or Delta class vehicles. Because of space constraints accompanying this shift to smaller class vehicles, satellite antenna systems must be packaged more efficiently in order to retain the size of a given aperture so as to prevent experiencing a loss in performance.

Antenna systems have generally been provided which meet the design constraints for large lift vehicles to a limited extent and for a limited frequency range. Mesh materials have been employed to serve as a reflector's ground plane material, and deployment schemes have been provided for allowing a reflector to collapse within a relatively small space when not in use. However, the use of mesh materials requires precise surface settings to eliminate undesirable losses, and current mesh reflectors have not obtained the lowest possible losses. For example, the use of a wire mesh material in combination with current deployment schemes allows a reflector to fold to thereby stow and unfold to thereby be deployed. Unfortunately, by putting multiple folds into the reflector to reduce the stowed height of the antenna system, the stowed diameter of the antenna system is correspondingly increased.

It is therefore desirable to provide a compact deployable antenna reflector for use with medium launch vehicles having a reduced stowed height and diameter without reducing the reflector aperture and performance.

More particularly, it is desirable to provide a telescoping antenna reflector that telescopes and unfolds when deployed, is lightweight, exhibits low losses, and meets the design constraints required for space communication applications and the like.

SUMMARY OF THE INVENTION

In accordance with the teachings of the present invention, an antenna reflector and method for deploying the same is disclosed. The antenna reflector includes a telescoping support assembly which includes a plurality of telescoping radially extending ribs. A plurality of interconnected guylines positioned between each of the telescoping radially extending ribs form a wire truss structure under tension having a front surface. A highly reflective wire woven mesh substantially covering the front surface of the wire truss structure is connected thereto and the telescoping support assembly.

In accordance with a preferred embodiment, the telescoping support assembly includes a telescoping mast which is coupled to the plurality of telescoping radially extending ribs such that as the mast extends from a stowed non-extended position to an extended position, the plurality of ribs each extend from the stowed non-extended position to the extended position.

In accordance with another preferred embodiment, each of the telescoping radially extending ribs includes an inner rib, having a first and a second end, and an outer rib, having a first and a second end. The first end of each of the inner ribs are pivotally coupled to the second end of each of the outer ribs for folding the inner and outer ribs to stow the antenna. A cylindrical hub having an opening therein for receiving the telescoping mast and having the first end of each of the outer ribs pivotally connected thereto is adapted to slide along the mast to thereby fold and unfold the inner and outer ribs.

BRIEF DESCRIPTION OF THE DRAWINGS

The various advantages of the present invention will become apparent to those skilled in the art after reading the following specification and by reference to the drawings in which.

DETAILED DESCRIPTION OF THE PREFERRED EMBODIMENTS

The following description of the preferred embodiments is merely exemplary in nature and is in no way intended to limit the invention or its application or uses.

The present invention is particularly concerned with providing a telescoping deployable antenna reflector for space communication applications having a reduced stowed height and diameter compared to prior antenna reflectors with the same size reflector aperture.

Figure 1:
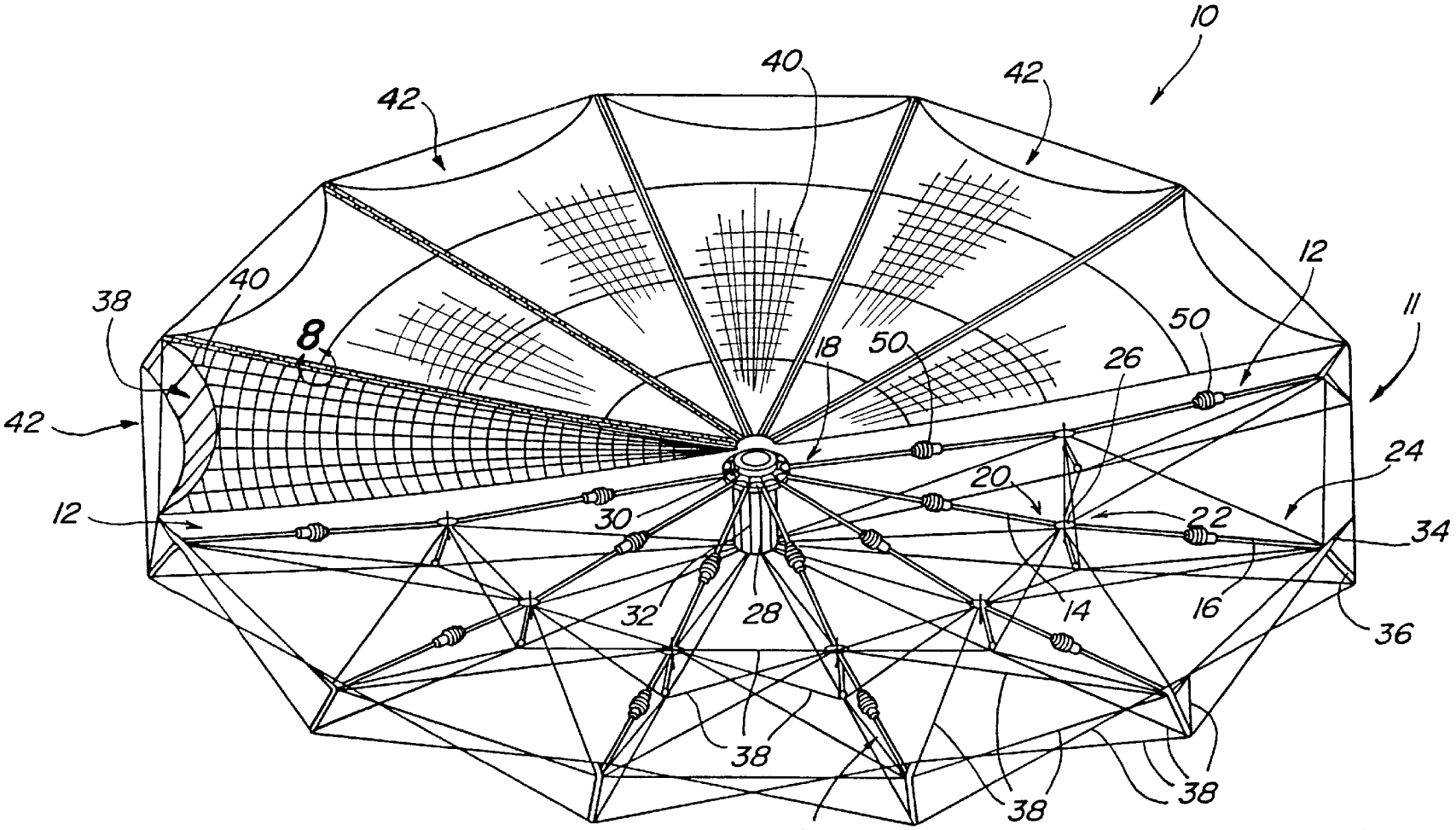
FIG. 1 is a schematic diagram illustrating a telescoping deployable mesh antenna reflector in accordance with the present invention.

Turning to FIG. 1, a deployable mesh antenna reflector 10 is shown therein. In general, the antenna reflector 10 includes a wire woven mesh 40 fastened to a telescoping deployable support assembly 11. More particularly, the support assembly 11 includes a plurality of telescoping radial extending ribs 12 which provide structural support. Each of the of the ribs 12 includes an inner rib 14 and an outer rib 16. The inner ribs 14 each include a first end 18 and a second end 20. Similarly, each of the outer ribs 16 includes a first end 22 and a second end 24. The inner and outer ribs 14 and 16 are folded. And the strut members 26 fold against outer ribs 16. Each of the first ends 18 of the inner ribs 14 are connected to a common cylindrical shaped hub 28. The hub 28 has an opening 30 disposed therein for accepting a telescoping cylindrical-shaped mast 32. Each of the plurality of telescoping radial extending ribs 12 includes a pair of front and rear spreader bars 34 and 36 located at the second end 24 thereof. The support assembly 11 of the reflector 10 further includes a plurality of wires or guylines 38 which further define and maintain the shape of the reflector 10. In addition, the plurality of guylines 38 substantially increase the structural stiffness and form a stable wire truss structure to which the wire mesh surface 40 is fastened.

As a result of this configuration, the plurality of ribs 12 form a like number of gores 42. Each gore 42 includes a plurality of precisely interconnected surface setting guylines 38 which span the plurality of telescoping radial extending ribs 12 and the spreader bars 34 and 36. As such, the surface setting guylines 38 form a substantially parabolic-shaped support structure to which the wire mesh material 40 is fastened.

Figure 2:
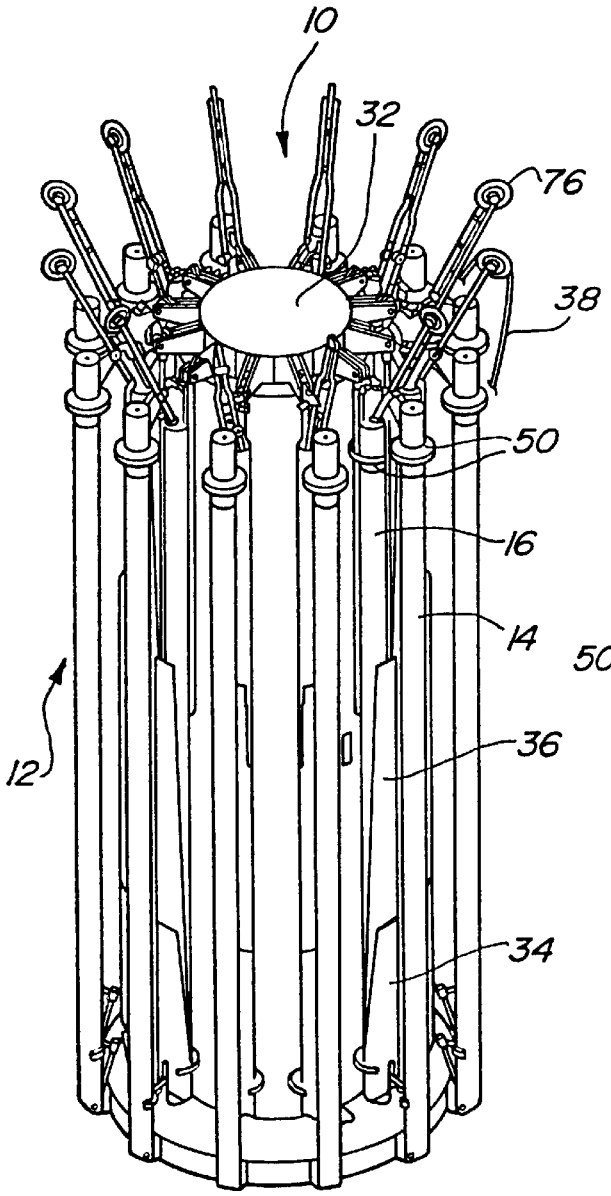
FIG. 2 is a schematic diagram illustrating the telescoping deployable mesh antenna reflector in a stowed non-extended position in accordance with the present invention.

The antenna reflector 10 is deployable in that it may be fully deployed as shown in FIG. 1, or the plurality of telescoping radial extending ribs 12 and spreader bars 34 and 36 may be collapsed, folded and thereby stowed as shown in FIG. 2. When stowed, each of the inner and outer ribs 14 and 16 and spreader bars 34 and 36 are collapsed and fold up against the collapsed mast 32. The inner and outer ribs 14 and 16 are folded. And the strut members 26 fold against outer ribs 16. As a result, the antenna reflector 10 may be stowed within a small space when not in use, and this is an important feature for space related applications especially where medium launch vehicles are employed due to reduced payload capabilities of such vehicles.

Figure 3:
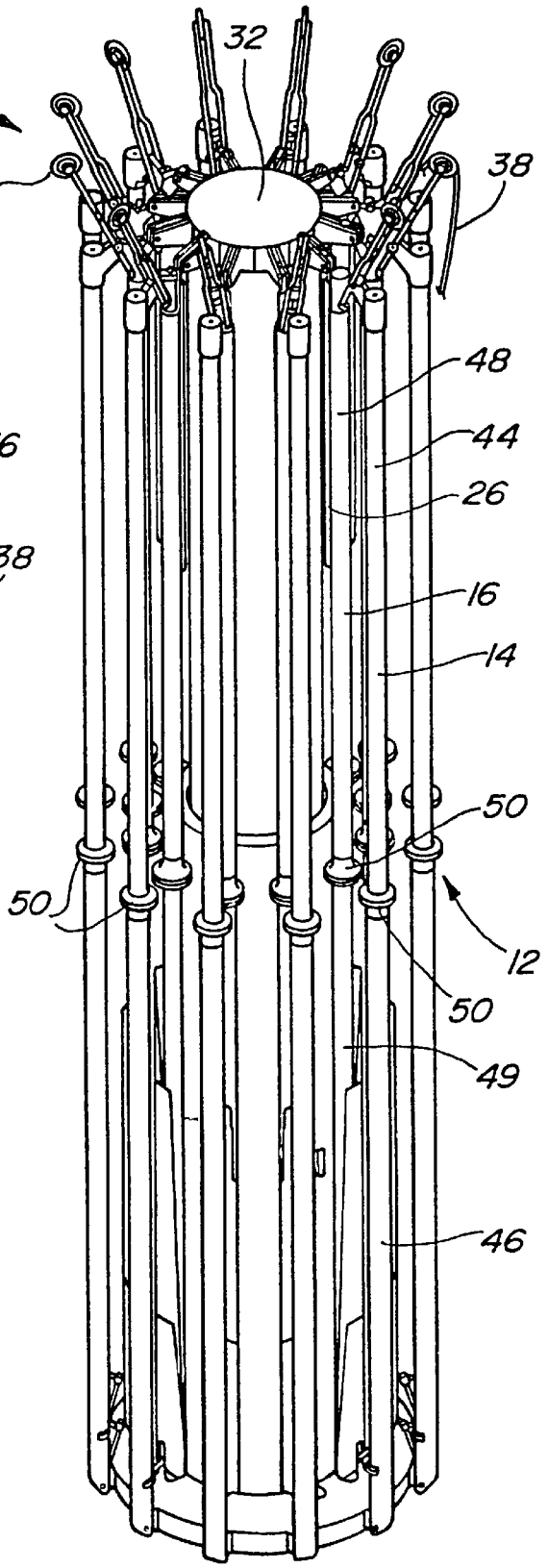
FIG. 3 is a schematic diagram illustrating the telescoping deployable mesh antenna reflector in an extended position in accordance with the present invention.

Turning to FIG. 3, the antenna reflector 10 is illustrated in an extended position. The telescoping mast 32 is coupled to the telescoping radially extending ribs 12 such that as the mast 32 extends from the stowed non-extended position, as shown in FIG. 1, to the extended position, each of the telescoping radially extending ribs 12 extend from the stowed non-extended position to the extended position. In order to telescope, each of the inner ribs 14 include inner tube segments 44 that telescope outward from within outer tube segments 46. Similarly, each of the outer ribs 16 include inner tube segments 48 that telescope outward from within outer tube segments 49. Each of the inner and outer ribs 14 and 16 include latching mechanisms 50 which secure the ribs 12 in the extended position. The operation of the latching mechanisms 50 will be discussed in detail below.

As will be apparent to one skilled in the art, the ability of the antenna reflector 10 to telescope from the stowed non-extended position illustrated in FIG. 1, to the extended position illustrated in FIG. 2, reduces the stowed height of the antenna reflector 10 without increasing the stowed diameter. As discussed above, this is an important feature for space related applications where the size of payloads are limited.

Figures 4A, 4B, 4C, 4D, 4E, 4F:
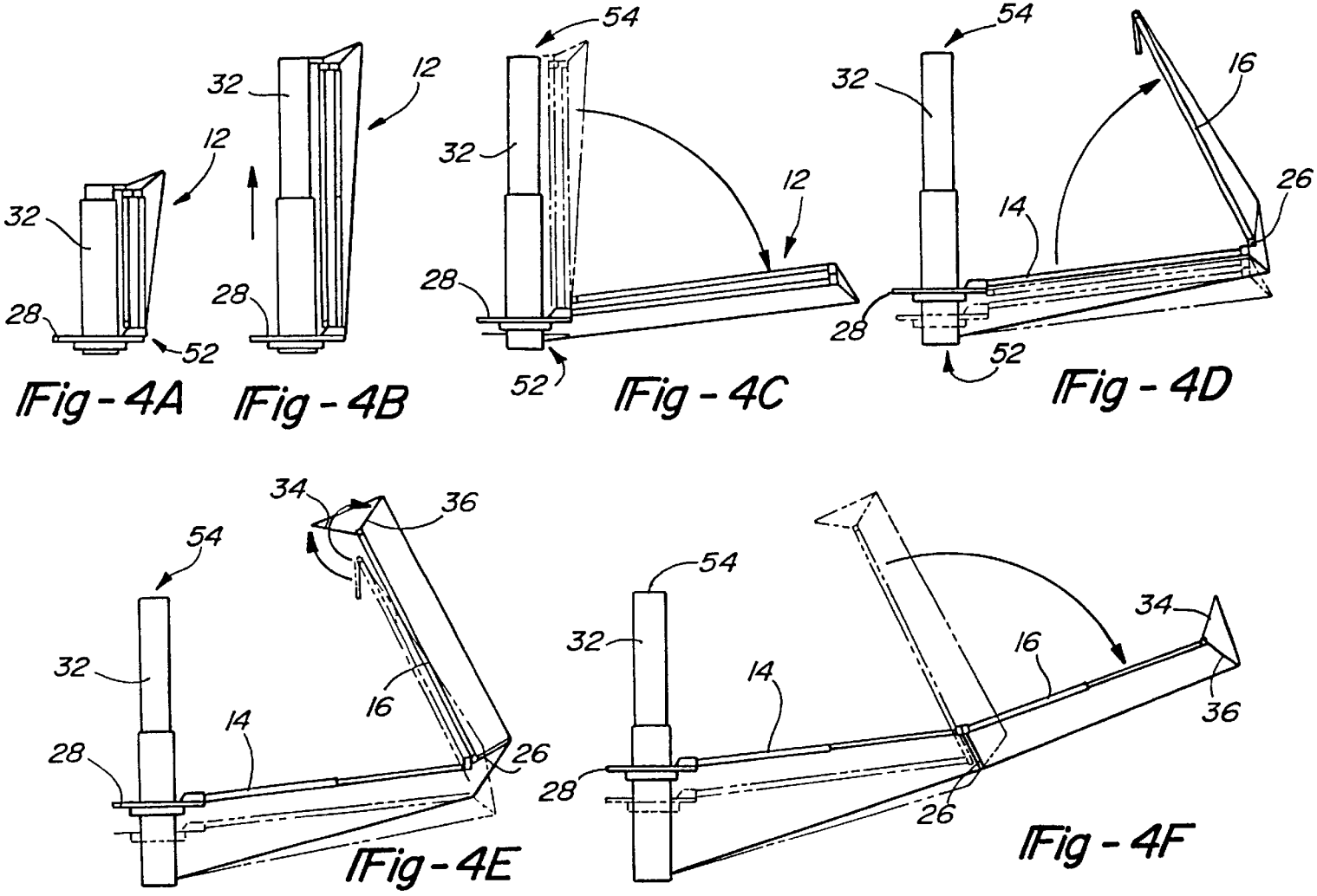
FIGS. 4A through 4F are schematic diagrams illustrating the deployment sequence of the telescoping deployable mesh antenna reflector in accordance with the present invention.

FIGS. 4A through 4F schematically illustrate the deployment sequence for deploying the antenna reflector 10. In order to carry out the deployment sequence, the hub 28 and the mast 32 employ a motor coupled to a cable drive (not shown) which when actuated in conjunction with various pulleys and the guylines 38, drive the hub 28 and the mast 32. FIG. 4A illustrates the antenna reflector 10 in the stowed non-extended position. Each of the telescoping radially extending ribs 12 are in a collapsed stowed non-extended position, and the hub member 28 is located at a lower end 52 of the mast 32 which is also collapsed. As shown in FIG. 4B, the mast 32 as well as the ribs 12 telescope or extend upwards to the extended position. Thereafter, as illustrated in FIG. 4C, as the hub 28 moves along the mast 32 towards a top end 54, the plurality of radially extending ribs 12 release and rotate outward from the mast 32 and thereby partially unfold. As shown in FIG. 4D, the hub 28 continues to move along the mast 32 such that the outer ribs 16 release and rotate about the pivot arm 76 away from the inner ribs 14. Turning to FIG. 4E, as the hub 28 continues to move along the mast 32, the spreader bars 34 and 36 as well as the strut members 26 are released and thereafter extend outward from the ribs 12. Lastly, as the hub member 28 continues toward the top end 54, the outer rib members 16 complete the a final rotation outward from the inner ribs 14 to a final deployed position. At this point, the antenna reflector 10 is fully deployed and produces a sufficient load to provide an appropriate shape for the mesh surface 40. During the deployment sequence, slack in the various guylines 38 is taken up so as to produce a rigid support assembly for the mesh surface 40.

Figure 5:
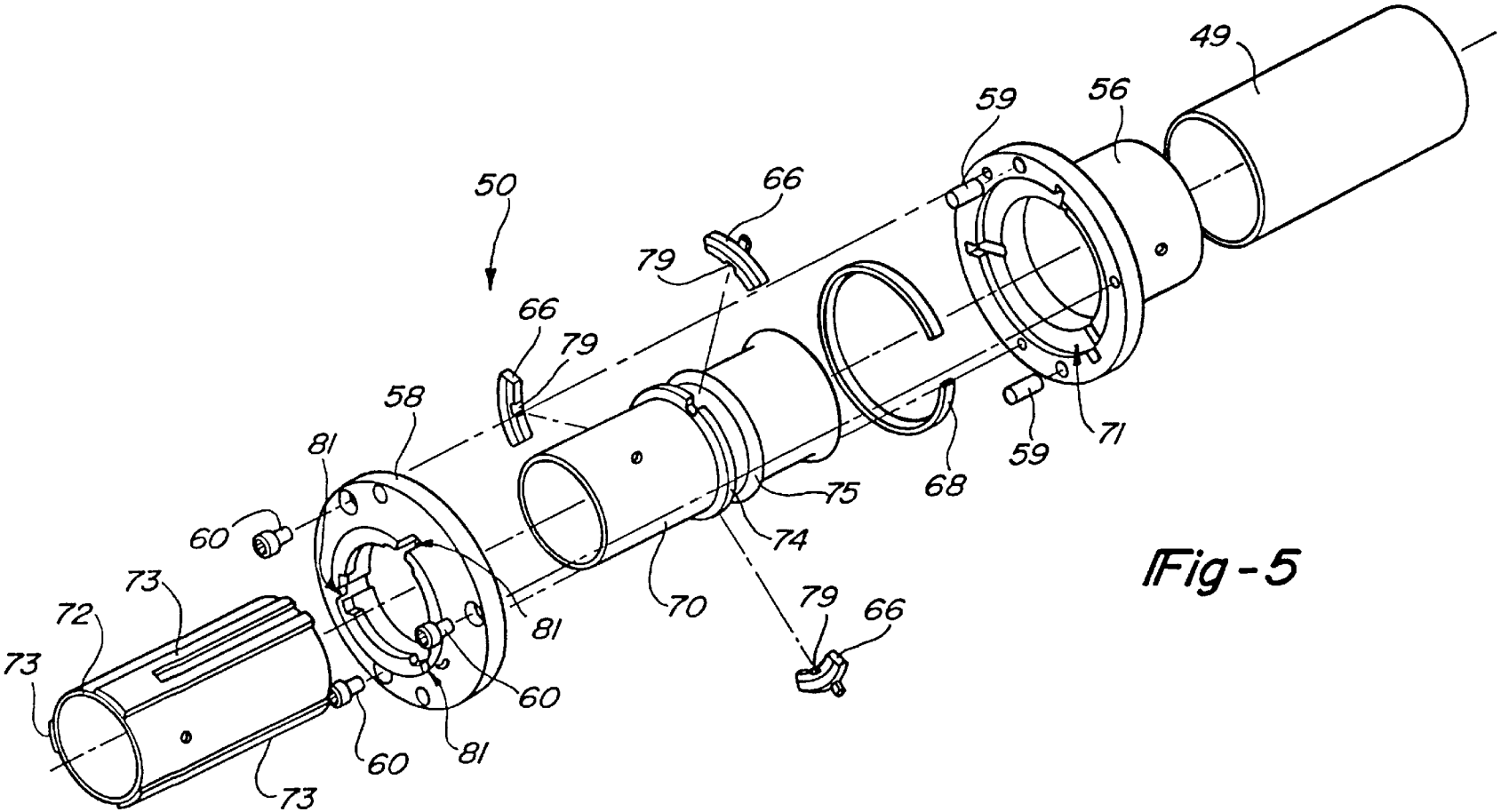
FIG. 5 is an exploded perspective view of a latching mechanism of the telescoping radially extending ribs in accordance with the present invention.

Turning to FIG. 5, an exploded perspective view of a representative latching mechanism 50 for the inner ribs 14 or the outer ribs 16 is illustrated. The latching mechanism 50 includes an end fitting 56 and an end cap 58 which are aligned by locating pins 59 and coupled by a plurality of fasteners 60. When used in conjunction with the outer ribs 16, the end fitting 56 is coupled to one of the outer tube segments 48. It should be noted that the latching mechanisms 50 operate in a similar manner in conjunction with the inner ribs 14. The latching mechanism 50 further includes three pawl latches 66 and a c-spring member 68. When the antenna 10 is in the stowed non-extended position, the c-spring 68 and the latches 66 are located within a recess 71 formed in the end fitting 56. A telescoping tube member 72 and a guide tube member 70 facilitate the telescoping of the inner tube segment 48 from within the outer tube segments 49 during the above-discussed deployment sequence. The telescoping tube member 72 includes integral guide rails 73 upon which the latches 66 slide. The guide tube member 70 includes raised portions 74 and 75 between which the latches 66 are received when the outer rib 16 telescopes from the stowed non-extended position into the extended position illustrated in FIG. 2.

Figure 6B:
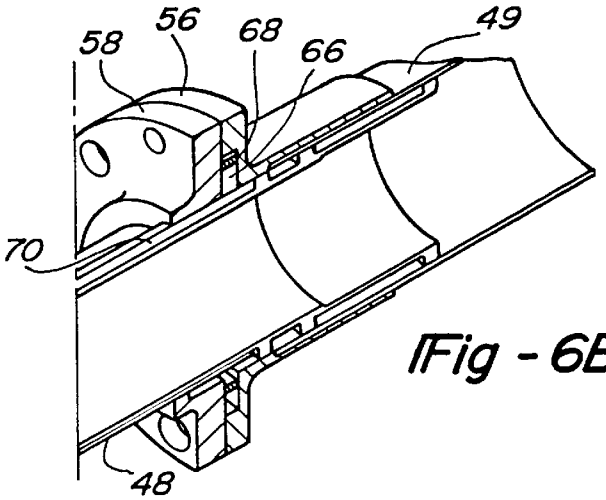
FIGS. 6A through 6G are schematic diagrams illustrating the telescoping sequence of a telescoping radially extending rib in accordance with the present invention.
Figure 6A:
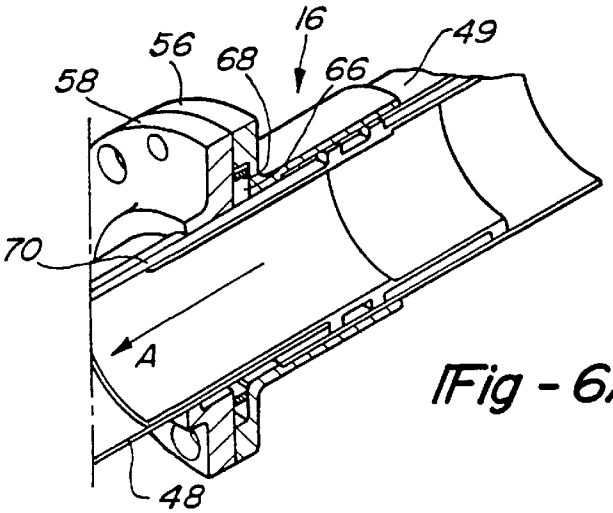
Figure 6D:
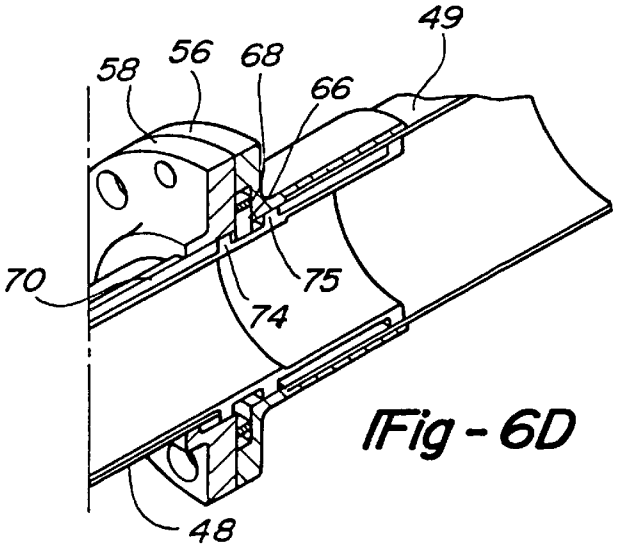
Figure 6C:
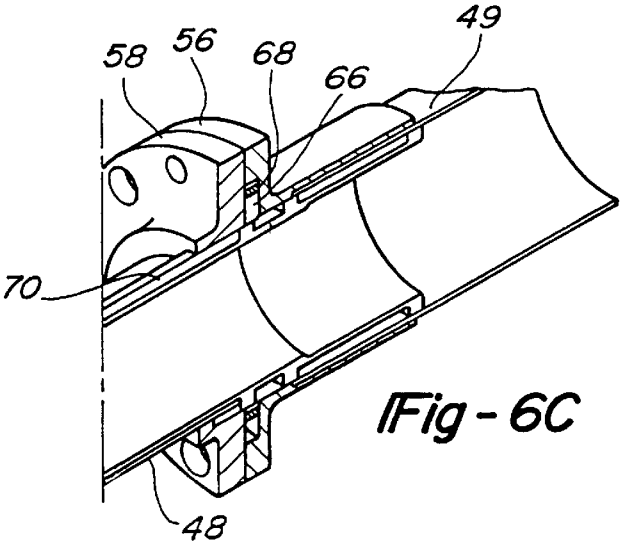
Figure 6G:
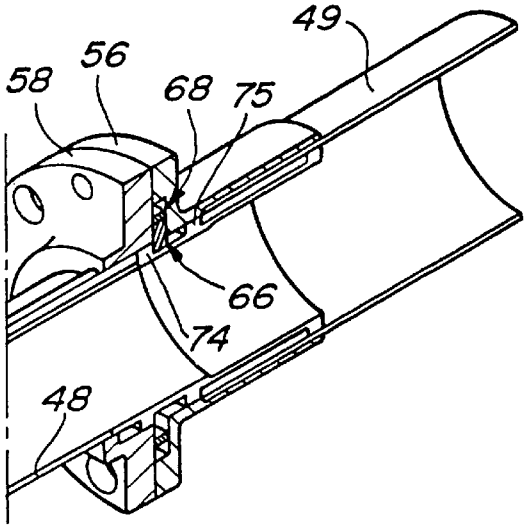
Figure 6F:
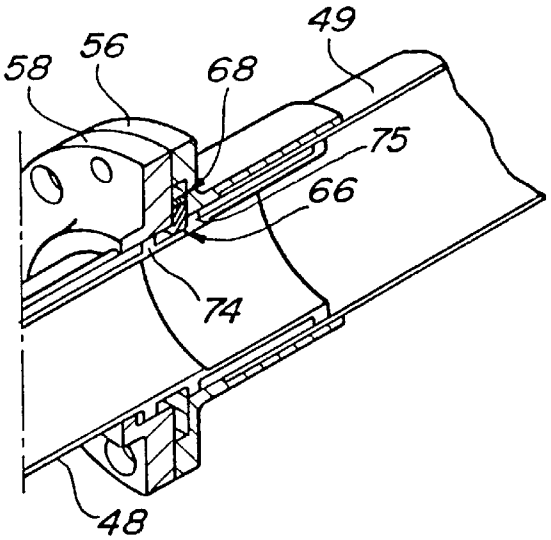
Figure 6E:
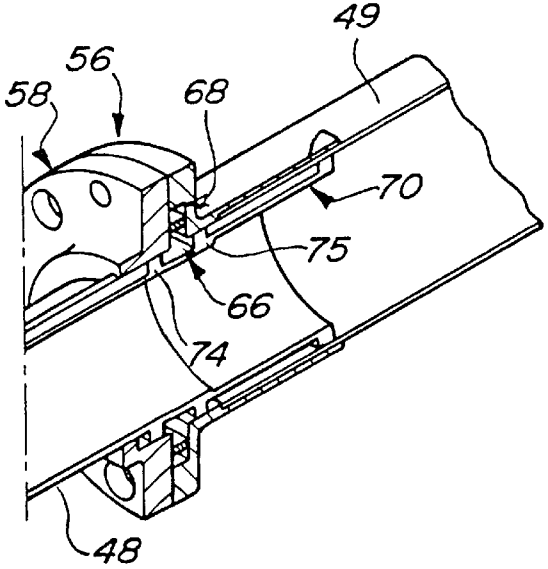

FIGS. 6A through 6B illustrate the latching sequence that occurs during the deployment sequence as discussed above in conjunction with FIGS. 4A through 4F. Referring to FIG. 6A, one of the outer ribs 16 is shown in a non-extended position with the latches 66 and c-spring member 68 preloaded within the end fitting 56. As illustrated in FIGS. 6B and 6C, during the telescoping sequence, the inner tube segment 48 and telescoping tube member 72 and guide tube member 70 telescope outward in a direction indicated by arrow A from within outer tube member 49. Turning to FIG. 6D, prior to reaching the deployed position, the c-spring 68 forces the latches 66 into the area between the raised portions 74 and 75. With reference to FIG. 6E, the inner tube segment 48 and the tube member 70 continue to telescope outward until the latches 66 bottom out against raised portion 75 as shown in FIG. 6F. Lastly, FIG. 6G shows tension from the guylines 38 reverse the direction of travel of the inner tube segment 48 and tube member 70 until the latches 66 bottom out and rest against the raised portion 74. At this point in the deployment sequence, the outer rib 16 is securely locked in the deployed extended position.

Referring again to FIG. 5, in order to unlock the inner rib 14 and outer rib 16, a wedge shaped tool (not shown) is inserted within openings 81 in the end cap 58 for engaging ramp shaped slots 79 in the latches 66. This forces the latches 66 and c-spring 68 away from the surface of the tube member 70 allowing ribs 14 and 16 the raised portions 74 and 75 to slide past the latches 66. This allows the rib 16 to be collapsed into stowed non-extended position.

Figure 7:
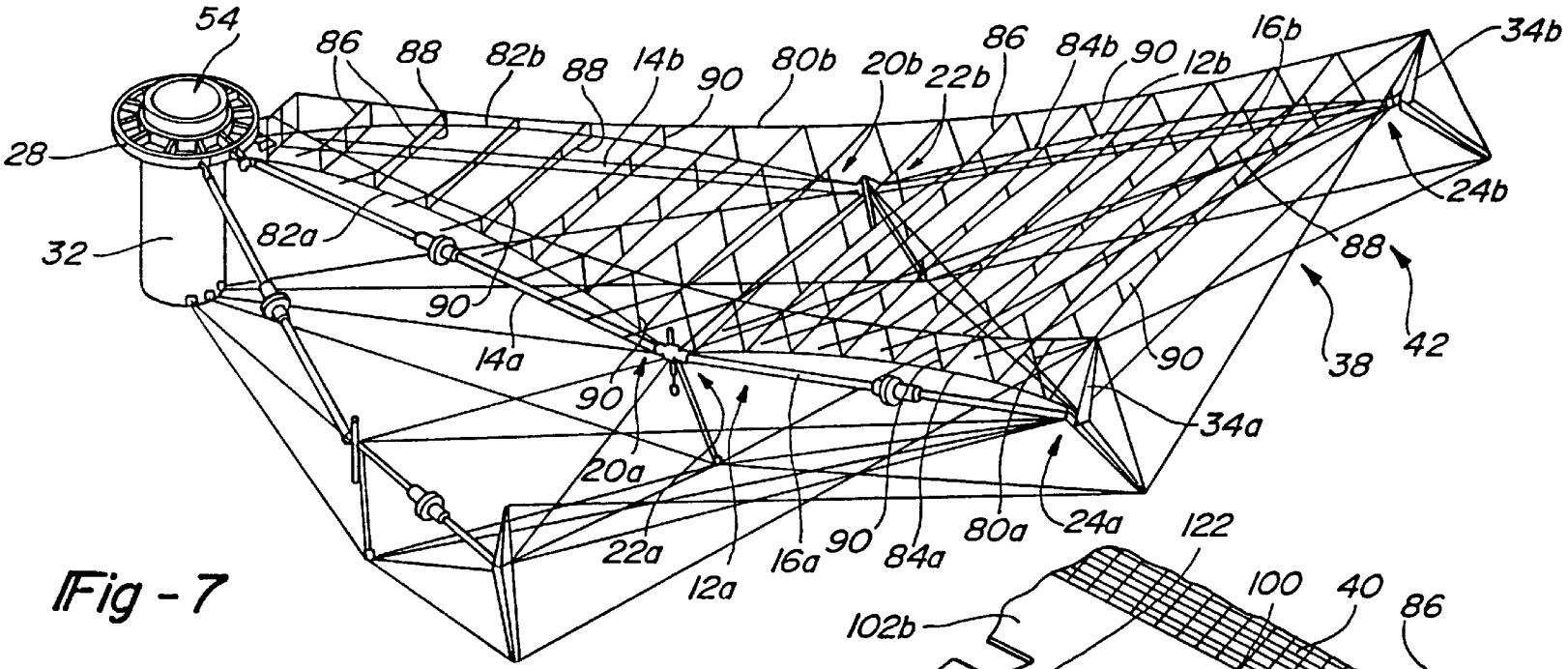
FIG. 7 is a cut away view of the telescoping deployable mesh antenna reflector illustrating the wire truss structure in accordance with the present invention.

FIG. 7 illustrates in detail one of the gores 42 of the antenna reflector 10. As shown, when deployed, the hub 28 is positioned near the top end 54 of the mast 32. As discussed above, the gore 42 includes a wire truss structure having a plurality of surface settings guylines 38 which are connected and remain under tension between a pair of telescoping radially extending ribs 12*a* and 12*b* to define a front and rear surface. The various surface setting guylines 38 include a pair of front radial catenary guylines 80*a* and 80*b* which extend from an upper or front position near the hub 28 rearwardly outward toward the tip of the spreader bars 34*a* and 34*b*. A first pair of rear radial catenary guylines 82*a* and 82*b* are also included which extend radially outward about the rear surface of the gore 42 from the hub 28 to the second ends 20*a* and 20*b* of inner ribs 14*a* and 14*b*. A second pair of rear radial catenary guylines 84*a* and 84*b* are included which extend radially outward about the rear surface from the first ends 22*a* and 22*b* of the outer ribs 16*a* and 16*b* to the second ends 24*a* and 24*b* of the outer ribs 16*a* and 16*b*. The rear radial catenary guylines 82*a* and 82*b* as well as 84*a* and 84*b* are essentially located in the rear surface plane of the gore 42 directly below the front radial catenary guylines 80*a* and 80*b* on the front surface of the gore 42.

A plurality of front cross-catenary guylines 86 are connected between the pair of front radial catenary guylines 80*a* and 80*b* on the front surface of the gore 42. Likewise, a plurality of rear-cross catenary guylines 88 are connected across the plurality of rear radial catenary guylines 82*a* and 82*b* as well as across rear radial catenary guylines 84*a* and 84*b* on the rear surface of the gore 42. In addition, a plurality of drop ties 90 are connected between the front radial catenary guylines 80*a* and 80*b* and the rear radial catenary guylines 82*a*, 82*b*, 84*a* and 84*b*. Furthermore, a plurality of drop ties 90 are connected between the front cross-catenary guylines 86 and the rear cross-catenary guylines 88.

As a result, the front radial catenary guylines 80*a* and 80*b* and the front cross-catenary guylines 86 form the front surface of the gore 42. The rear cross-catenary guylines 88 and rear radial catenary guylines 82*a*, 82*b*, 84*a* and 84*b* form the rear surface of the gore 42 which is connected to the front surface with the plurality of drop ties 90. As illustrated in FIG. 1, the wire woven mesh material 40 is then essentially fastened to the front surface of each of the plurality of gores 42 to form the antenna reflector 10. The conglomerate of surface setting guylines 38 thereby operate to provide the precise antenna reflector surface setting necessary for minimizing various reflector losses by controlling the shape or contour in each gore 42.

Figure 8:
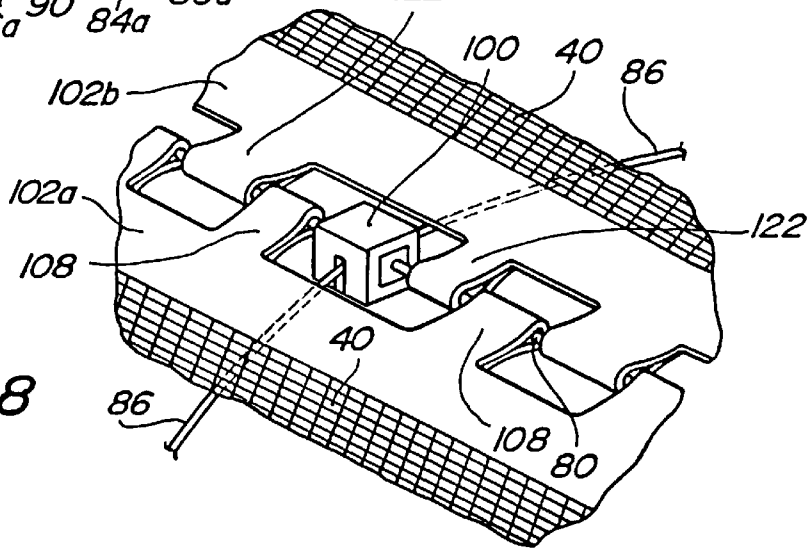
FIG. 8 is a view, about section 8 of FIG. 1, illustrating the flexible radially extending strip members for gore attachment in accordance with the present invention.

With reference to FIG. 8, in order to precisely maintain the desires surface setting of the gore 42, various surface setting guylines 38 are connected together or fastened with a plurality of integral fitting assemblies 100. FIGS. 1 and 8 illustrate the location of one of the integral fitting assemblies 100. A front radial catenary guyline 80 extends through the integral fitting 100 and the front-cross catenary guylines 86 are coupled to one another via the integral fitting assembly 100. The wire woven mesh material 40 from two adjoining gores 42 are connected to the front surface of the reflector 10 with radially extending strip members 102*a* and 102*b*. The members 102*a* and 102*b* are made from a flexible material such as Nomex fabric and are located at the intersection of the adjoining gores 42. As illustrated, the front radial catenary guyline 80 extends through sleeves 108 in the radial strip 102*a* and sleeves 122 in radial strip 102*b*. The radial strips are in turn secured to the mesh material 40 of the gores 42.

The wire woven mesh material 40 is a highly reflective gold plated molybdenum wire woven into an approximately 28 to 32 openings-per-inch mesh knit pattern. This wire woven mesh material 40 provides for ultra-low signal loss at high frequencies. The very low signal loss mesh surface allows for a wider spacing of the drop ties 90 while maintaining minimal signal loss requirements. It is believed that mesh knit patterns having less than 28 openings-per-inch are disadvantageous because the spacing of the drop ties 90 would not be practical, while patterns having greater than 32 openings-per-inch are likewise not preferred because of high mesh stiffness. The use of the radial strips 102*a* and 102*b* to connect the gores 42 allows for the folding of the inner and outer ribs 14 and 16 in order to stow the reflector 10 and allows for the deployment scheme illustrated in FIGS. 4A–4F to be utilized. Previous antenna reflectors included rigid radial strip members which would not permit such folding and unfolding of the antenna reflector which, in turn, increased the storage volume of such previous reflectors.

Figure 9:
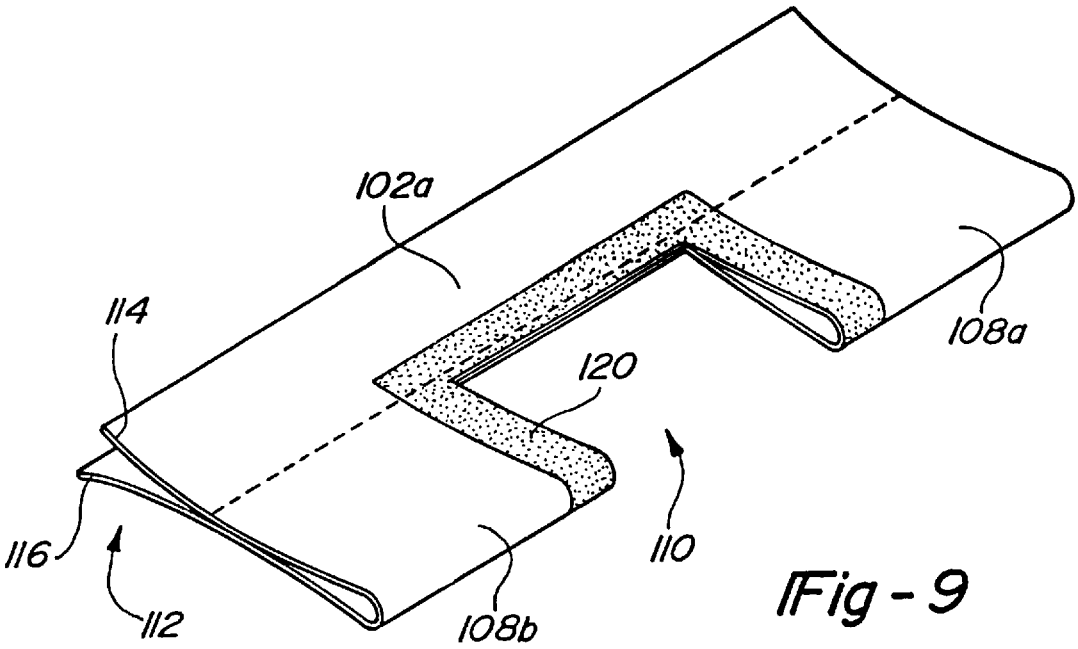
FIG. 9 is a cutaway section of the flexible radially extending strip member in accordance with the present invention.

FIG. 9 is a cutaway view of a section of the radial strip 102*a*. The radial strip 102*a* includes a sleeve portions 108*a* and 108*b* with a notch 110 located therebetween. The mesh surface 40 (not shown) is secured between an overlap section 112 including portions 114 and 116. A black polyurethane adhesive 120 is located between the portions 114 and 116 as well as around the edges of the notch portion 110.

From the foregoing, it can be seen that compared to prior deployable antenna reflectors, the telescoping deployable antenna reflector 10 has a reduced stowed height and diameter when compared to prior antenna reflectors having a same size aperture. An additional advantage of the present invention is that the antenna reflector 10 may be folded about itself due to the use of the flexible radial strip members which again allows the stowed volume of the antenna reflector 10 to be minimized.

The foregoing discloses and describes merely exemplary embodiments of the present invention. One skilled in the art will readily recognize from such discussion, and from the accompanying drawings and claims, that various changes, modifications and variations can be made therein without departing from the spirit and scope of the present invention as defined by the following claims.

What is claimed is:

1. An antenna reflector comprising:

a foldable telescoping support assembly including a plurality of telescoping radially extending ribs, each of the plurality of telescoping radially extending ribs including a telescoping inner rib having a first and a second end, and a telescoping outer rib having a first and a second end, the second end of each of the inner ribs being pivotally coupled to the first end of each of the outer ribs by a strut member to enable the inner and outer ribs of each of the plurality of telescopically radially extending ribs to be folded to a position longitudinally adjacent one another;

a plurality of interconnected guylines positioned between each of the telescoping radially extending ribs to form a wire truss structure under tension having a front surface; and a highly reflective wire woven mesh connected to the front surface of the wire truss structure, whereby the telescoping radially extending ribs telescope from a stowed non-extended position to an extended position during deployment of the reflector.

2. The reflector as defined in claim 1, wherein the telescoping support assembly further includes:

a telescoping mast which is coupled to the plurality of telescoping radially extending ribs such that as the mast extends from a stowed non-extended position to a extended position, the plurality of telescoping radially extending ribs each extend from the stowed non-extended position to the extended position.

3. The reflector as defined in claim 2, further comprising:

a cylindrical hub having an opening therein for receiving the telescoping mast and having the first end of each of the inner ribs pivotally connected thereto, the hub being adapted to slide along the mast to thereby fold and unfold the inner and outer ribs.

4. The reflector as defined in claim 3, wherein the radially extending ribs are folded and the antenna therefore stowed when the hub is located at one end of the telescoping mast, and the radially extending ribs being unfolded and the antenna thereby deployed when the hub slides towards an opposite end of the telescoping mast.

5. The reflector as defined in claim 2, wherein the telescoping support assembly further comprises:

a first and a second spreader bar extending from the second end of each of the outer ribs of the telescoping radially extending ribs.

6. The reflector as defined in claim 5, wherein the wire truss structure further includes a rear surface which is connected to the second end of the plurality of outer ribs and wherein the front surface is connected to the first spreader bar, the front and rear surfaces being connected therebetween with a plurality of drop tie guylines.

7. The reflector as defined in claim 2, wherein each of the plurality of telescoping radially extending ribs includes at least one latching mechanism that securely fastens each of the ribs when extended from the stowed non-extended position to the extended position.

8. The reflector as defined in claim 7, wherein the latching mechanisms include a plurality of spring actuated latches.

9. The reflector as defined in claim 1, wherein the wire woven mesh is connected to the front surface of the wire truss structure by a plurality of flexible radially extending strip members.

10. The reflector as defined in claim 1, wherein the wire woven mesh has approximately 28 to 32 openings-per-inch.

11. The reflector as defined in claim 10, wherein said wire woven mesh comprises gold plated molybdenum.

12. An antenna reflector comprising:

a telescoping mast;

a plurality of foldable telescoping radially extending ribs coupled to the telescoping mast such that as the mast extends from a stowed non-extended position to an extended position, the plurality of telescoping radially extending ribs each extend from the stowed non-extended position to the extended position, each of the telescoping radially extending ribs including a telescoping inner rib, having a first and a second end, and a telescoping outer rib, having a first and a second end, the second end of each of the inner ribs being pivotally coupled to the first end of each of the outer ribs by a strut member for folding the telescoping inner and outer ribs to a position longitudinally adjacent one another to stow the antenna;

each of the telescoping radially extending ribs including at least one latching mechanism that securely fastens each of the ribs when extended from the stowed non-extended position to the extended position;

a first and a second spreader bar extending from the second end of each of the outer ribs of the telescoping radially extending ribs;

a plurality of interconnected guylines positioned between each of the telescoping radially extending ribs to form a wire truss structure under tension having a front surface and a rear surface, the rear surface is connected to the second end of the plurality of outer ribs and the front surface is connected to the first spreader bar, the front and rear surfaces are connected therebetween with a plurality of drop tie guylines; and a highly reflective wire woven mesh connected to and substantially covering the front surface of the wire truss structure.

13. The reflector as defined in claim 12, further comprising:

a plurality of flexible radially extending strip members for connecting the wire woven mesh to the front surface of the wire truss structure.

14. The reflector as defined in claim 13, further comprising:

a cylindrical hub having an opening therein for receiving the telescoping mast and having the first end of each of the inner ribs pivotally connected thereto, the hub being adapted to slide along the mast to thereby fold and unfold the inner and outer ribs.

15. The reflector as defined in claim 12, wherein the at least one latching mechanism includes a plurality of spring actuated latches.

16. A method for deploying a mesh antenna reflector, said method comprising the steps of:

providing a telescoping support assembly including a plurality of telescoping radially extending ribs each having inner and outer ribs with second ends of each of the inner ribs pivotally coupled to first ends of each of the outer ribs and first ends of each of the inner ribs pivotally connected to a cylindrical hub, a plurality of support wires interconnecting the plurality of telescoping radially extending ribs and the cylindrical hub for providing a wire truss structure having front and rear surfaces, and a wire woven mesh material coupled to the front surface;

actuating the telescoping support assembly such that each of the plurality of telescoping radially extending ribs each extend from a stowed non-extended position to an extended position;

rotating the inner and outer ribs from the extended position to a first rotated position;

rotating the outer ribs from the first rotated position to a second rotated position; and rotating the outer ribs from the second rotated position to a final rotated position.

17. The method for deploying a mesh antenna reflector of claim 16, further comprising the step of:

securing each of the plurality of telescoping radially extending ribs in the extended position with a plurality of latching mechanisms.

18. The method for deploying a mesh antenna reflector of claim 16, further comprising the step of:

re-stowing the antenna reflector by unsecuring the plurality of telescoping radially extending ribs and collapsing the ribs to the stowed non-extended position.

* * * * *